US005682630A

United States Patent [19]

Simon

[11] Patent Number: 5,682,630

[45] Date of Patent: Nov. 4, 1997

[54] STORABLE PATIENT LIFT AND TRANSFER APPARATUS

[76] Inventor: William H. Simon, 1313 Partridge La., Villanova, Pa. 19085

[21] Appl. No.: 720,518

[22] Filed: Sep. 30, 1996

Related U.S. Application Data

[63] Continuation-in-part of Ser. No. 291,407, Aug. 16, 1994, Pat. No. 5,560,054.

[51] Int. Cl.[6] ..... A61G 7/10

[52] U.S. Cl. ..... 5/87.1; 5/83.1; 5/86.1

[58] Field of Search ..... 5/81.1 R, 83.1, 5/84.1, 85.1, 86.1, 87.1

[56] References Cited

U.S. PATENT DOCUMENTS

| | | | |
|---|---|---|---|
| 686,425 | 11/1901 | Sommerfield | 5/86.1 |
| 935,170 | 9/1909 | Smith | 5/86.1 |
| 2,666,930 | 1/1954 | Lenahan | 5/86.1 |
| 4,837,874 | 6/1989 | Giercarz et al. | 5/84.1 |
| 4,999,862 | 3/1991 | Hefty | 5/87.1 |
| 5,459,891 | 10/1995 | Reeve et al. | 5/87.1 |
| 5,560,054 | 10/1996 | Simon | 5/83.1 X |

*Primary Examiner*—Michael F. Trettel
*Attorney, Agent, or Firm*—McHale & Slavin, P.A.

[57] ABSTRACT

A portable lifting apparatus for lifting and transferring of patients for use in combination with a sling or the like support. The apparatus consists of an upright tower-like base unit with a lower base section and a vertically extending armature with a hingably mounted lifting boom. The apparatus can be placed into an operational position in a minimal amount of time by lifting of the boom and deployment of the support legs. The boom would incorporate a lifting mechanism consisting of an electrically driven linear actuator, and/or a hydraulic or pneumatic piston. Deployment status might be verified by readouts on a centralized control panel or remote control unit. Wheels under the base unit might be controllably driven to aid in moving the lifting apparatus in either a stowed or deployed position. In a retracted state, the apparatus can be stored in a small area such as a closet having a footprint no larger than the size of the base unit. Portability is provided by wheels under the base unit and extended support legs.

18 Claims, 3 Drawing Sheets

STORABLE PATIENT LIFT AND TRANSFER APPARATUS

This is a Continuation-In-Part of Ser. No. 08/291,407 filed Aug. 16, 1994, now U.S. Pat. No. 5,560,059.

BACKGROUND OF THE INVENTION

1. Field of the Invention

This invention relates generally to hoisting equipment and more particularly, to a portable lifting apparatus for lifting and transferring incapacitated persons.

2. Background Information

It is well known that persons confined to a bed due to illness, age, and so forth possess such limited mobility that movement or transfer is extremely difficult. Improper transfer can result in serious complications to the individual. For instance, the need to move a patient immediately after an operation is necessary yet a dangerous proposition as any movement of the body may undo the surgeon's most careful work. Just as important is the need to transfer a bed ridden person for bathing or exercise so as to facilitate recovery.

In a hospital setting, a transfer is typically performed by a number of hospital workers in order to comfortably lift a patient from one position to another. If the transfer is made only by hand, the hospital personnel risk injury to their backs. If the transfer utilizes too few personnel or requires reaching in an awkward position, the personnel may strain their own bodies. Despite the number of personnel employed to assist in the transfer, the patient is simply susceptible to injury from anyone who touches or lifts incorrectly.

For these reasons, a number of devices are presently available for lifting and lowering of incapacitated persons from a bed, chair, bath or the like position. U.S. Pat. No. 5,185,895, issued to Gagne, sets forth a patient lift device consisting of a base frame having vertically oriented guideposts wherein a carriage assembly moves along the guideposts in response to an operator applied control signal. An arm assembly projects over the person who is placed into a sling for lifting. The patent discloses a basic lift and transferring apparatus of the prior art. The problem with such a device is the size necessary in order to accomplish the intended service. In particular, the prior art device employs elongated legs and a boom which is necessary to lift a patient. This prevents the device from being easily transferred or stored. The length of the components are necessary so that the apparatus can fit beneath a bed or chair yet provide sufficient support during the lifting process.

Thus a primary problem with the instant apparatus, as well as the remainder of the known prior art, is that the support and lifting structure must be sized adequately in order to support the lifting of the patient. However, the structure interferes with transportation and storage of the device. Since all components in the prior art remain in an extended position, they may cause a person to trip or run into the device. Such a device is difficult to transport and store for the legs and boom remain in an outward position.

U.S. Pat. No. 5,084,921 is another example of a patient lift and transfer apparatus having a unitary frame which consists of a caster wheel equipped U-shaped horizontal disposed frame. The invention discloses a unique vertically disposed pivotally biased arm to lift a patient supporting sling for moving a patient. Again the legs of this apparatus are capable of being placed beneath a patient's bed providing sufficient support for the lifting apparatus as well as the patient. However, no provision is made for storage or transportation of the apparatus.

U.S. Pat. No. 4,712,257 is still another patient lift device consisting of a lifting arm and sling hanger supported by a rigid frame having a U-shaped base structure using wheels for ease of frame movement. The invention further discloses the use of a sling having spaced apart attachment points for use in combination with a vertical bearing to prevent swinging movement of a patient placed within the sling.

U.S. Pat. No. 5,077,844 sets forth an apparatus for lifting and moving patients wherein the frame is permanently attached to a fixed structure. This apparatus eliminates the need for legs but limits the use to non-portable placement.

U.S. Pat. No. 4,484,366 sets forth a patient transfer device which again relies upon the use of a fixed base which fits beneath the patient's chair or bed making the unit impractical to store in a compact position. U.S. Pat. No. 5,185,895 discloses an apparatus for lifting patients and transporting them. The apparatus is based upon electrical motors to provide assistance in patient movement wherein the arm members can telescope and then retract. This apparatus does not teach the retraction of the arms for purposes of storage or transportation.

Thus, there is a need for a lifting and transferring apparatus which is simple to operate and retracts into a compact position to permit ease of storage and transportation of the apparatus.

SUMMARY OF THE INVENTION

The present invention satisfies this need through provision of a retractable lifting apparatus. The apparatus meets the particular problems commonly found in hospitals and convalescent homes where short term lifting capabilities are necessary. Unique to this invention is the ability to lift over three hundred pounds and yet retract in size for purposes of transporting and storage. In operation the retractable support legs provide an eighty inch stance. In a retracted position, the support legs are pivoted upward and are foldably received into the base of the unit leaving a small frame footprint. The invention consists of a compact base unit which houses a miniature lifting crane comprising a boom with a lifting mechanism and a patient attachment means at the end of the boom. The boom is coupled to the portable frame and lifts up from its vertical stowed position to its operational horizontal position by a lifting mechanism. The lifting mechanism would consist of an electrically driven linear actuator or a cable driven system which would be controlled via a remote control or lifting frame mounted control panel which operates on alternating current (AC) and/or direct current (DC). Alternatively, an electrically controlled hydraulic or pneumatically assisted lifting mechanism can be used if heavier loads are expected. The boom itself is then coupled to the patient and used to lift and lower the patient based upon the relative vertical positioning of the boom.

A pair of side legs fold out and lock into place from a recess in each side of the base unit, a frontal support leg extends outward from a centrally disposed position. Each leg is hinged in the middle and at the end by use of a support brace which extends upward into the unit from a middle attachment point. Hingably mounted door may be included to conceal each leg within a recess. The front extending leg folds outward from a cavity which houses the vertically stowed boom device, the leg conveniently stores under the lowered boom. This front extending leg is generally longer than the side legs in order to counter the weight suspended from the boom. As with the side legs, the front leg is hinged in the middle with a hingably mounted brace extending upward into the storage cavity. By drawing the braces upward from the hinged centers of each leg, the legs unlock and compactly fold into their respective storage areas. Each leg also has a roller or wheel on its bottom to facilitate moving the deployed unit.

Once the apparatus is in a retracted position, the unit can be easily moved by unlocking leg and frame mounted wheels. Such wheels might be lockable caster wheels similar to those found on stretchers. Alternatively, the wheels in the base unit could be electrically driven with directional controls provided via the remote or frame mounted control unit. The unit might then be moved more easily in either a loaded or unloaded configuration. Vertically oriented handles along the base unit frame are also included to provide a convenient handhold for moving the unit about.

In the extended position, an operator can maneuver the lifting device over a patient's bed wherein a hook or attachment means is available for attaching to a patient sling. The sling is placed beneath the patient to facilitate support during transfer. The boom moves through a lifting range of motion of approximately 90 degrees from a stowed vertical position to a horizontal position.

A control panel is provided for operation of all moving components and consists of control keys, switches, and indicators on the base unit located at a convenient level for operation by a user. The control panel would include controls for deploying and retracting the side legs. Boom elevation controls would also be provided. The front leg could be controllably extended once the boom has been elevated sufficiently to allow the stored front leg to clear the boom. Controls for the wheels, if powered, might consist of directional arrows or a joystick for moving the unit. Indicator lights or digital or analog readouts might also be provided to show the status of various components.

Thus, an objective of the instant invention is to provide a patient lift device or apparatus that is simple to operate and employs retractable components so as to permit storage in a closet or transportation through doorways.

Yet another objective of the instant invention is to disclose the use of a wheeled, vertically oriented base unit with legs which are foldably concealed within the base unit, and with a boom which swings upward to lift a patient.

Yet still another objective of the instant invention is to provide a device that can be operated by a single person and is easily moveable in confined areas such as those found in a hospital or convalescent home.

Still another objective of the instant invention is to teach a means for retracting support legs, such retraction may be in the form of hinge couplings or a telescoping configuration. Yet another objective of the instant invention is to provide for controllably driven wheels on the base unit for easy mobilization of the lifting device.

Another objective of the instant invention is to provide a lifting apparatus that can be placed into operation, from a stored condition in a minimal amount of time, for instance less than two minutes. The extending components are geared and/or configured, so as to meet this time frame yet provide a mode of extension that is stable for use in fragile environments.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
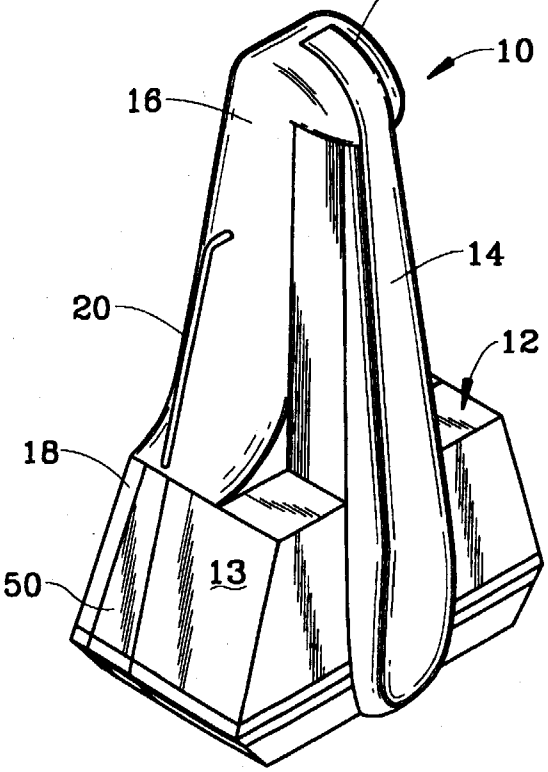
FIG. 1 shows a pictorial view of the lifting device of the instant invention in its closed, compact configuration.

Referring now to FIG. 1, the preferred embodiment of the lifting device 10 is shown in its closed, or stored configuration. The device 10 is comprised of a tower-like base unit 12 and a swingable boom 14. The boom 14 is hingably attached 15 to an armature 16 which extends upwards from the base bottom 18. As shown in this stored configuration, the boom 14 is lowered to a near-vertical orientation to reside within an opening in the base unit housing 13. The lifting device 10, now in a compact size, can be manually moved by grasping handles 20 which are attached on each side of the base unit 12.

Figure 2:
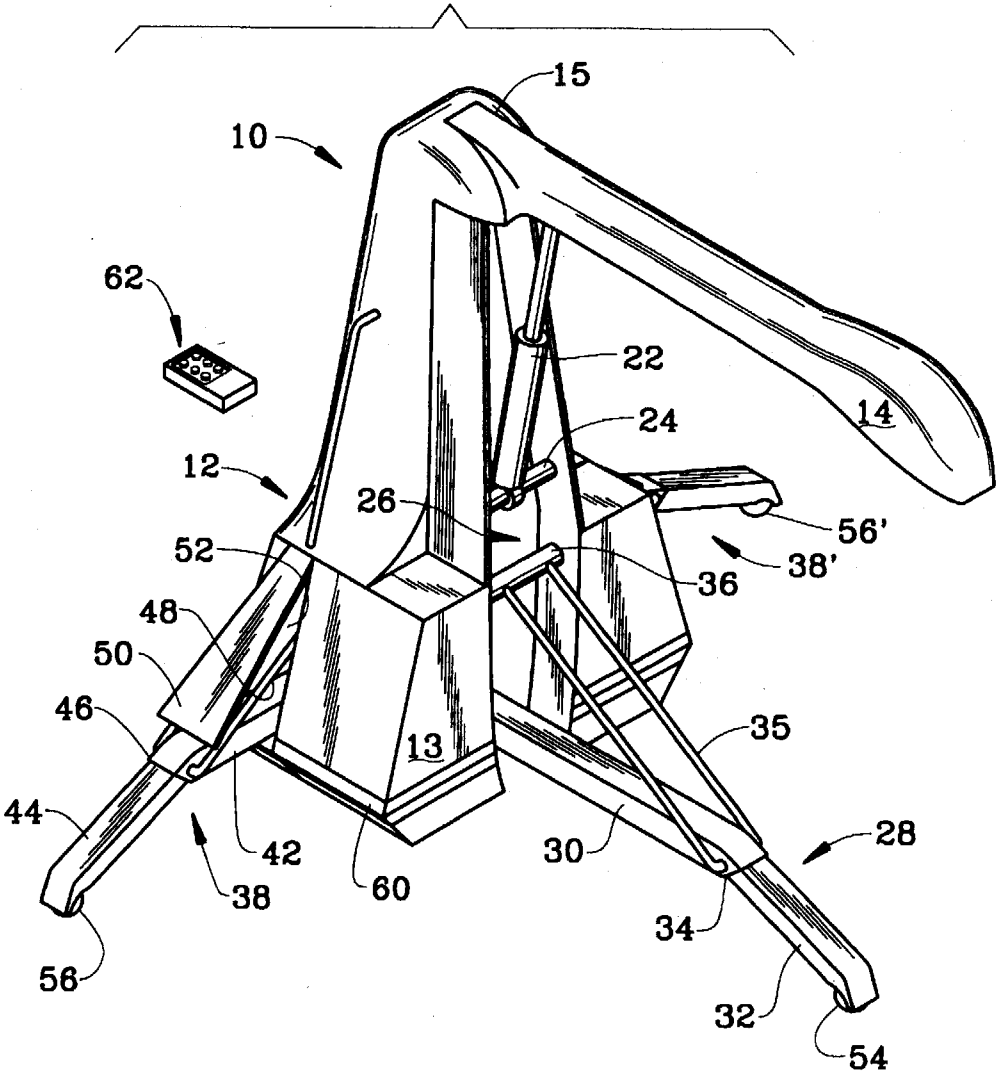
FIG. 2 shows a pictorial view of the lifting device of FIG. 1 in its open, deployed configuration.

Referring also to FIG. 2, the lifting device 10 is illustrated in a deployed position. The boom 14 is rotated about its hinge 15 to a generally horizontal position. A lifting mechanism 22 is rotatably attached at its lower end to a mount 24, and at its upper end to the boom 14. A frontal storage cavity 26 receivably contains the mechanism 22 when the boom is folded downward.

Figure 2A:
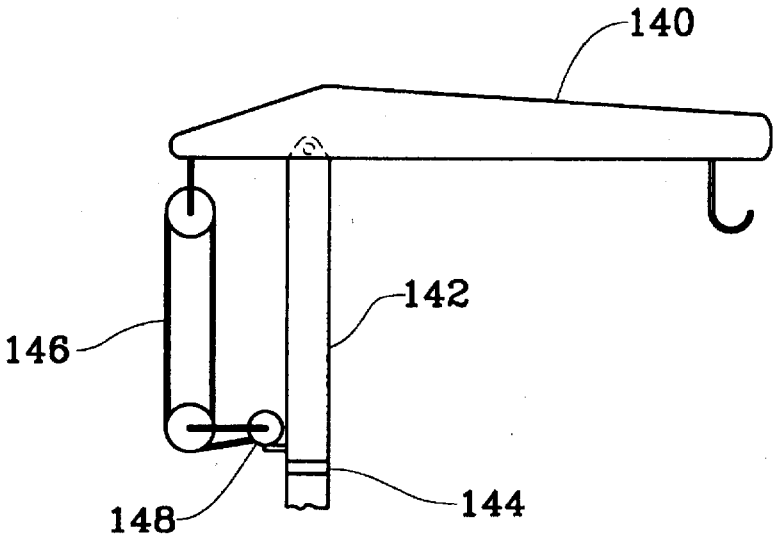

FIG. 2A depicts an alternative embodiment having a boom 140 that is preferably support by a cylindrical suppoort 142 with a support base bearing means 144 that allows for rotation movement of the boom 140 at least 45 degrees from right to left. In this embodiment a cable assembly 146 provides lift to the boom with a winch 148 allowing for the raising or lowering of the boom 140.

Cavity 26 also receivable houses an extendable front leg 28 which is comprised of an inner section 30 and outer section 32. The inner and outer sections 30 and 32 are hingably attached 34 to lock when fully extended, and to bend upwards when pulled by a strut 35. The strut 35 attaches on either side of the leg 28 near the hinge 34. The strut 35 is attached at its other end to a rotatable mount 36 which raises and draws the strut 35 into the storage cavity 26. This unlocks the leg 28 and foldably draws sections 30 and 32 into the storage cavity 26. When the front leg 28 has been fully folded within the cavity 26, the boom 14 can be lowered to conformably seal around the cavity 26 as shown in FIG. 1. The legs are positively locked into place when either positioned in the extended or stored position. Electrical interlocks may be included to permit lifting only when the legs are fully extended and locked.

Similar to the front folding leg 28, a pair of side legs 38 and 38' provide lateral stability for the deployed lifting device 10. As detailed for the leg shown, an inner section 42 and an outer section 44 are hingably attached 46 to bend upwards. A strut 48 is attached near the hinge 46 on the leg 38 at one end, and the strut 48 is attached to a withdrawal means inside the base 12 at the other end. A swinging door 50 covers and protects the folded leg assembly 38 and strut 48 when they are withdrawn into the storage cavity 52. When the leg 38 is retracted, the door 50 mounts flush against the base housing 13 as shown in FIG. 1. It should be noted that the legs may also be telescoping, or be a combination of hinge and telescoping with the intent to provide stability to the device while in an operational mode and a small footprint when in a storage position.

Figure 2B:
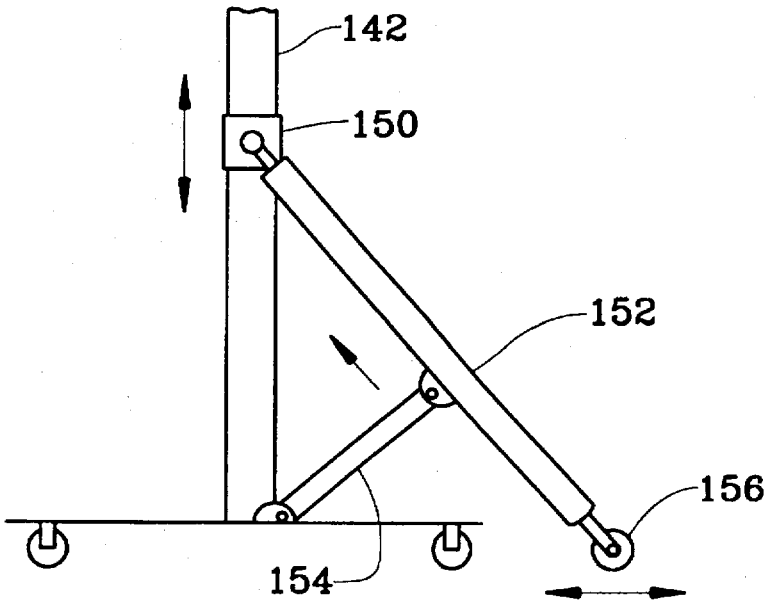

In an alternative embodiment as depicted by FIG. 2B, the legs can be operated concurrently by use of a single support post such as 3½ inch diameter schedule 40 pipe having a 4inch slider sleeve 150 wherein leg is extended outward upon movement of said sleeve 150 in a downward direction having pivot bar 154 provide positioning of the leg 152 and main support or wheel 156 located at the end of the leg 152. The slider sleeve will allow for movement of all legs, not shown, simultaneously when one end of each leg is coupled to the sleeve.

Additionally, each leg 28, 38, and 38' has a coaster or wheel assembly 54, 56, and 56' on it bottom. The base housing 13 flares outward as shown and a rubberized bumper or rub rail 60 might be placed around the housing to prevent damaging contact with walls or other surrounding objects. A remote control unit 62 is also shown which might be wireless or hardwired to control the lifting device 10.

Figure 3:
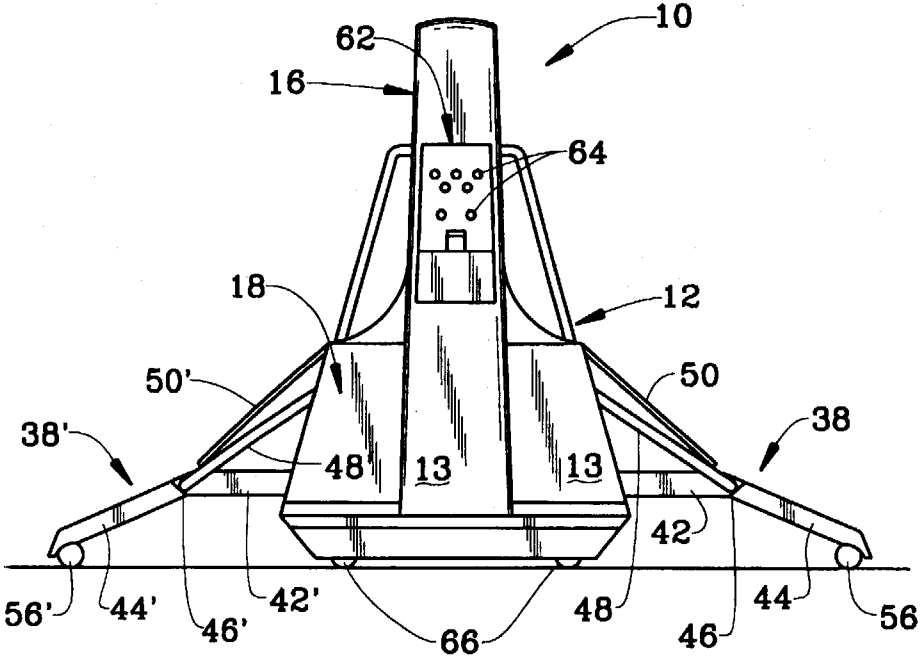
FIG. 3 shows a rear view of the deployed lifting device of FIG. 2.

Referring now to FIG. 3, a rear view of the deployed device 10 of FIG. 2 is shown. The legs 38 and 38' are shown with their similar component parts: inner leg sections 42 and 42' and outer leg sections 44 and 44' which are hingably mounted at 46 and 46'; wheels 56 and 56'; and struts 48 and 48' which foldably draw legs upward, with the folded components covered by doors 50 and 50' in the lower section 18 of the base 12. The armature 16 extends vertically upward and has a control panel 62 conformably mounted in the base unit housing 13. The housing is sized to contain DC batteries should the consumer desire a self-contained power supply. In addition, the housing may also include a battery changer for maintenance of the batteries. The control panel 62 has various buttons and/or switches 64 which might be used to control extension and withdrawal of the support legs 28, 56, and 56'. The preferred embodiment is operated on alternating current employing a drive motor that operates on a commonly available voltage supply. Other buttons and/or switches 64 might provide for raising and lower of the boom 14. Still other buttons and/or switches 64 might control directional movement of the wheels 66 on the bottom of the base unit 12, if they are so motorized and controllably driven.

Figure 4:
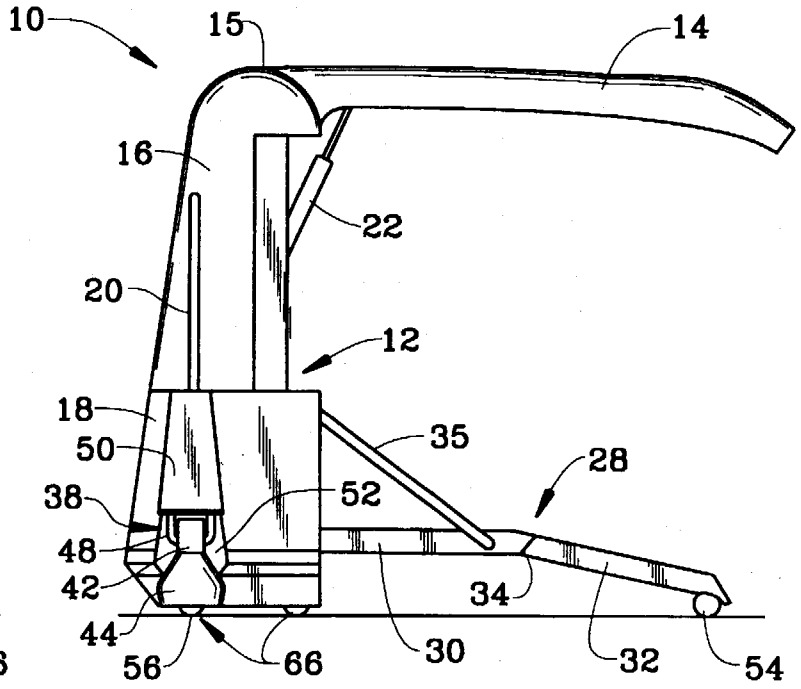
FIG. 4 shows a side view of the deployed lifting device of FIG. 2.

Referring now to FIG. 4, a side view of the deployed device 10 of FIG. 2 is shown. This side view illustrates a boom hingably attached 15 to the upper armature 16 of the base unit 12. The lower portion 18 of the base unit 12 again shows the leg assembly 38 with component parts 42, 44, strut 48, and wheel 56. The door 50 is open slightly to reveal storage cavity 52. The front leg assembly 28 again shows its component parts 30, 32, strut 35, and wheel 54. The wheel 56 on the leg assembly 38 is shown to align with and conceal the wheels 66 on the bottom of the base unit 12. This view also more clearly shows the placement of the handles 20 for moving the lifting device 10.

It is to be understood that while I have illustrated and described certain forms of my invention, it is not to be limited to the specific forms or arrangement of parts herein describe and shown. It will be apparent to those skilled in the art that various changes may be made without departing from the scope of the invention and the invention is not to be considered limited to what is shown in the drawings and described in the specification.

What I claim is:

1. A lifting apparatus comprising:

a power means;

an upright base unit having a lower base section and an upwardly extending armature section, said base unit including a frontal storage cavity and a first and second side storage cavity;

a boom hingably mounted to said armature section, said boom rotating from a vertical orientation covering said frontal storage cavity to a horizontal orientation;

a lifting means operably connected to said base unit and said boom, said lifting means being foldably stored in said frontal storage cavity;

a front leg support assembly;

a pair of side leg support assemblies; and a means for positioning said front leg and side leg support assemblies in an extended position for operation and a retracted position for storage.

2. The lifting apparatus according to claim 1, wherein said power means includes an AC connector.

3. The lifting apparatus according to claim 1, wherein said power means includes an rechargeable battery pack with a recharger connector.

4. The lifting apparatus according to claim 1, wherein said lifting means includes an electrical linear actuator.

5. The lifting apparatus according to claim 1, wherein said lifting means includes an hydraulically assisted piston.

6. The lifting apparatus according to claim 1, wherein said base unit includes a wheel means for moving the base unit about.

7. The lifting apparatus according to claim 1, wherein said wheel means are controllably driven.

8. The lifting apparatus according to claim 1, wherein each said support leg includes a wheel means.

9. The lifting apparatus according to claim 1, wherein said base unit include an attached handle for grasping and moving said apparatus.

10. The lifting apparatus according to claim 1, wherein said base unit includes at least one attached handle for grasping and moving said apparatus.

11. The lifting apparatus according to claim 1, wherein said base unit includes a centralized control panel with status indicators for controlling retraction and deployment of said legs and said boom.

12. The lifting apparatus according to claim 11, wherein said base unit includes a centralized control panel with status indicators for controlling retraction and deployment of said legs and said boom, with additional directional controls for said driven wheels.

13. The lifting apparatus according to claim 1, wherein said base unit includes a remote control unit with status indicators for controlling retraction and deployment of said legs and said boom.

14. The lifting apparatus according to claim 1, wherein said base unit includes a remote control unit with status indicators for controlling retraction and deployment of said legs and said boom, with additional directional controls for said driven wheels.

15. The lifting apparatus according to claim 1, wherein said base unit includes a protective rail around said lower base section.

16. The lifting apparatus according to claim 1, wherein said front leg support is defined by an inner and outer front leg section hingably connected to bend upwards from a locked position, with a rotatably mounted front strut for foldably lifting said leg, said front leg assembly being foldably stored in said frontal storage cavity underneath said boom.

17. The lifting apparatus according to claim 1, wherein said side leg supports are each defined by an inner and outer side leg section hingably connected to bend upwards from a locked position, with a rotatably mounted side strut for foldably lifting said leg, each said side leg assembly being foldably stored in each said first and second side storage cavity and covered by a swinging side door hingably mounted on each side.

18. The lifting apparatus according to claim 1, wherein said leg supports include a telescoping means.

* * * * *